US007587162B2

(12) United States Patent
Davidson et al.

(10) Patent No.: US 7,587,162 B2
(45) Date of Patent: Sep. 8, 2009

(54) MULTI-TAP SERIES CERAMIC HEATER COLD SPOT COMPENSATION

(75) Inventors: Malcolm G Davidson, Fairport, NY (US); Nathan E Smith, Hamlin, NY (US); Brian Gillis, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 160 days.

(21) Appl. No.: 11/854,575

(22) Filed: Sep. 13, 2007

(65) Prior Publication Data

US 2009/0074484 A1 Mar. 19, 2009

(51) Int. Cl.
*G03G 15/20* (2006.01)

(52) U.S. Cl. ..... 399/329; 219/216; 399/328

(58) Field of Classification Search ..... 399/330, 399/329, 328, 334; 219/216, 469, 470; 430/124.1, 430/124.3, 124.31; 118/60; 347/156
See application file for complete search history.

(56) References Cited

U.S. PATENT DOCUMENTS

| | | | | |
|---|---|---|---|---|
| 5,285,049 | A * | 2/1994 | Fukumoto et al. | 219/216 |
| 6,353,718 | B1 | 3/2002 | Roxon et al. | |
| 6,734,397 | B2 * | 5/2004 | Kato et al. | 219/216 |
| 6,882,804 | B2 * | 4/2005 | Eskey | 219/216 X |
| 7,193,180 | B2 | 3/2007 | Cook et al. | |
| 7,228,082 | B1 | 6/2007 | Davidson et al. | |
| 7,483,664 | B2 * | 1/2009 | Roof | 399/328 |
| 2004/0245236 | A1 * | 12/2004 | Cook et al. | 219/216 |

FOREIGN PATENT DOCUMENTS

| | | | |
|---|---|---|---|
| JP | 01-013778 | A * | 1/1989 |
| JP | 05-029067 | A * | 2/1993 |
| JP | 11-242989 | A * | 9/1999 |

* cited by examiner

*Primary Examiner*—Sophia S Chen

(57) ABSTRACT

An improved fuser includes a heater that enhances uniform heating by altering the localized resistance which alters the localized power output of a resistive trace at the point of contact with a conductor trace in order to provide extra heating and thereby compensate for heat loss at the resistive trace/conductor trace junction.

9 Claims, 6 Drawing Sheets

MULTI-TAP SERIES CERAMIC HEATER COLD SPOT COMPENSATION

This invention relates generally to electrostatographic reproduction machines, and more particularly, to a fuser adapted to handle multiple paper widths.

In electrostatographic printing, commonly known as xerographic or printing or copying, an important process step is known as "fusing". In the fusing step of the xerographic process, dry marking making material, such as toner, which has been placed in imagewise fashion on an imaging substrate, such as a sheet of paper, is subjected to heat and/or pressure in order to melt the otherwise fuse the toner permanently on the substrate. In this way, durable, non-smudging images are rendered on the substrates.

The most common design of a fusing apparatus as used in commercial printers includes two rolls, typically called a fuser roll and a pressure roll, forming a nip therebetween for the passage of the substrate therethrough. Typically, the fuser roll further includes, disposed on the interior there of, one or more heating elements, which radiate heat in response to a current being passed therethrough. The heat from the heating elements passes through the surface of the fuser roll, which in turn contacts the side of the substrate having the image to be fused, so that a combination of heat and pressure successfully fuses the image. As shown in U.S. Pat. No. 7,193,180 B2, for example, a resistive heater is disclosed that is adapted for heating a fuser belt with the heater comprising a substrate, a first resistive trace formed over the substrate, and a second resistive trace formed so as to at least partially overlap the first trace.

Provisions can be made in fusers to take into account the fact that sheet of different sizes may be passed through the fusing apparatus, ranging from postcard-sized sheets to sheets which extend the full length of the rolls. Further, it is known to control the heating element or elements inside the fuser roll to take into account the fact that a sheet of a particular size is being fed through the nip. For example, in U.S. Pat. No. 6,353,718 B1 a fuser roll is shown with two parallel lamps or heating elements therein that in each case include a relatively long major portion of heating-producing material along with a number of smaller portions of heat-producing material with all being connected in series. Within each lamp, a major portion is disposed toward one particular end of the fuser roll, while the relatively smaller portions are disposed toward the opposite end of the fuser roll. This particular configuration of heating elements within each lamp will have a relatively hot and relatively cold end. That is, when electrical power is applied to either lamp, one end of the lamp will largely generate more heat that the other end of the lamp.

U.S. Pat. No. 7,228,082 B1 discloses printing machine that includes a fuser for fusing an image onto a sheet. The fuser includes an endless belt having a plurality of predefined sized fusing areas that are selectively activatable and the plurality of predefined sized fusing areas are arranged in a substantially parallel manner along a process direction of the belt. A means for activating one or more of the plurality of predefined sized fusing areas to correspond to one of the selected predefined sized sheets. Multi-tap series controlled ceramic heaters of this design have a flaw in that a conductor interface to the heat-producing materials creates a cold spot which reduces the heater temperature locally and creates a radial cold area in the fuser roll causing image quality issues. The heretofore mentioned patents are included herein to the extent necessary to practice the present disclosure.

The problem that needs to be addressed is cold spots on a segmented ceramic fuser heater at the point of contact between the resistive trace (for heating) and the conductive trace (the electrical lead). Segmented heating elements provide better temperature control for different media widths. An electrical contact to the segments is needed within the image area, and current designs exhibit a cold spot at that point due to conductive cooling.

Accordingly, an improved fuser is disclosed that includes a heater that provides uniformity at the surface of the fuser that contacts an imaged sheet by reducing the width of a resistive trace at the point of contact with a conductor trace to provide extra heating to compensate for heat loss at the junction. In one embodiment, the temperature is increased locally near the interface between a resistive trace and a conductor trace mounted on a ceramic member by altering the localized resistance which alters the localized power output which increases temperature locally and increases temperature flow into the ceramic at and near the conductor trace. In a second embodiment, temperature locally near the interface between a resistive trace and a conductor is increased by connecting two or more resistive traces to offset conductor traces. A third embodiment combines reducing an area of resistive traces at an interface with offset conductor traces for improved uniformity of current flow.

The disclosed printer and fuser system may be operated by and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'printer' or 'reproduction apparatus' as used herein broadly encompasses various printers, copiers or multifunction machines or systems, xerographic or otherwise, unless otherwise defined in a claim. The term 'sheet' herein refers to any flimsy physical sheet or paper, plastic, or other useable physical substrate for printing images thereon, whether precut or initially web fed. A compiled collated set of printed output sheets may be alternatively referred to as a document, booklet, or the like. It is also known to use interposers or inserters to add covers or other inserts to the compiled sets.

As to specific components of the subject apparatus or methods, or alternatives therefor, it will be appreciated that, as normally the case, some such components are known per se' in other apparatus or applications, which may be additionally or alternatively used herein, including those from art cited herein. For example, it will be appreciated by respective engineers and others that many of the particular components mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

Figure 1:
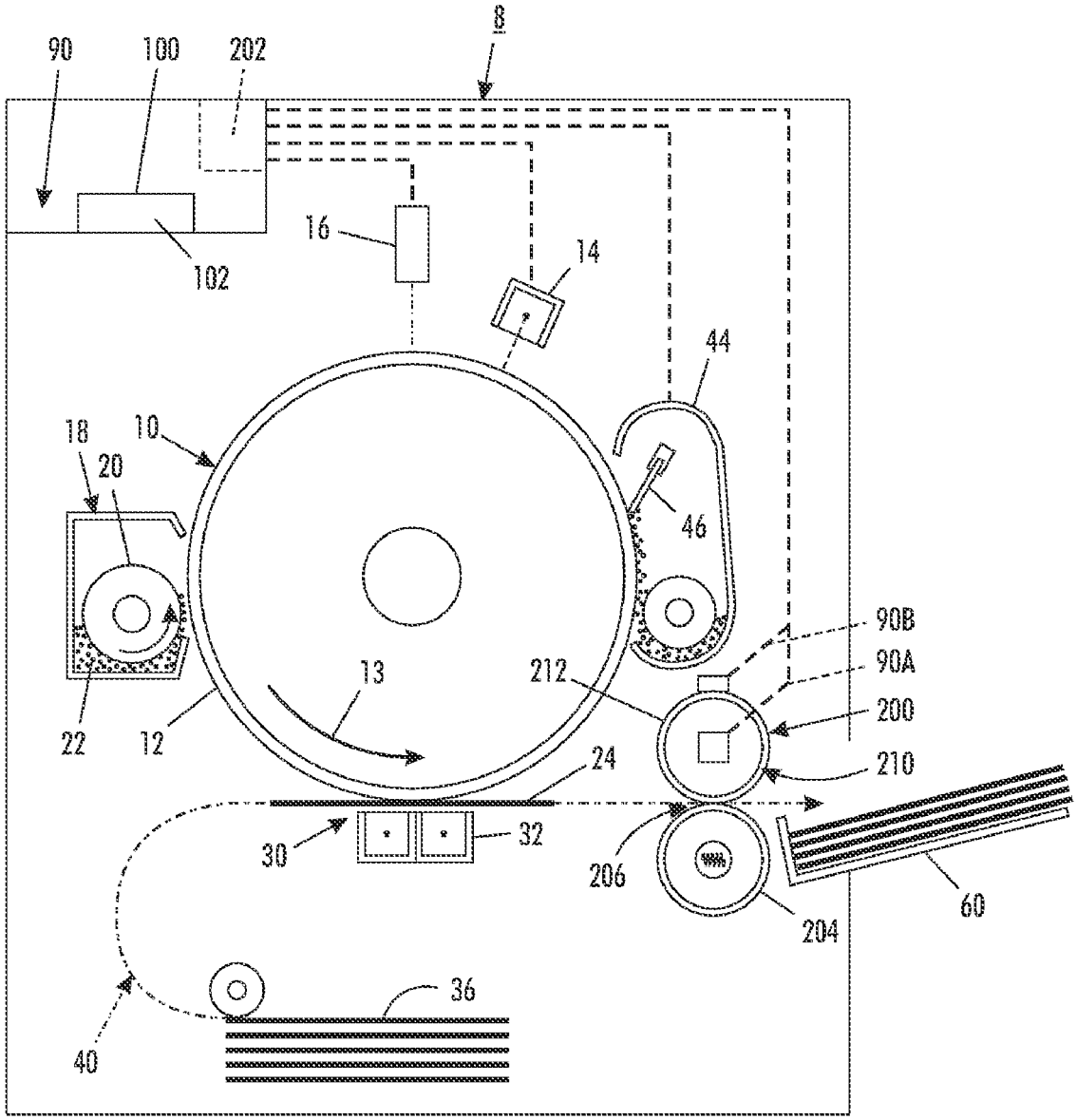
FIG. 1 is an elevational view showing relevant elements of an exemplary toner imaging electrostatographic machine including a first embodiment of the fusing apparatus of the present disclosure.

Referring now to FIG. 1, an electrostatographic or toner-imaging machine 8 is shown. As is well known, a charge receptor or photoreceptor 10 having an imageable surface 12 and rotatable in a direction 13 is uniformly charged by a charging device 14 and imagewise exposed by an exposure device 16 to form an electrostatic latent image on the surface 12. The latent image is thereafter developed by a development apparatus 18 that, for example, includes a developer roll 20 for applying a supply of charged toner particles 22 to such latent image. The developer roll 20 may be of any of various designs, such as, a magnetic brush roll or donor roll, as is familiar in the art. The charged toner particles 22 adhere to appropriately charged areas of the latent image. The surface of the photoreceptor 10 then moves, as shown by the arrow 13, to a transfer zone generally indicated as 30. Simultaneously, a print sheet 24 on which a desired image is to be printed is drawn from sheet supply stack 36 and conveyed along sheet path 40 to the transfer zone 30.

At the transfer zone 30, the print sheet 24 is brought into contact or at least proximity with a surface 12 of photoreceptor 10, which at this point is carrying toner particles thereon. A corotron or other charge source 32 at transfer zone 30 causes the toner image on photoreceptor 10 to be electrostatically transferred to the print sheet 24. The print sheet 24 is then forwarded to subsequent stations, as is familiar in the art, including the fusing station having a high precision-heating and fusing apparatus 200 of the present disclosure, and then to an output tray 60. Following such transfer of a toner image from the surface 12 to the print sheet 24, any residual toner particles remaining on the surface 12 are removed by a toner image baring surface cleaning apparatus 44 including a cleaning blade 46 for example.

As further shown, the reproduction machine 8 includes a controller or electronic control subsystem (ESS), indicated generally by reference numeral 90 which Is preferably a programmable, self-contained, dedicated mini-computer having a central processor unit (CPU), electronic storage 102, and a display or user interface (UI) 100. At UI 100, a user can select one of the pluralities of different predefined sized sheets to be printed onto. The ESS 90, with the help of sensors 90A and 90B, a look-up table 202 and connections, can read, capture, prepare and process image data such as pixel counts of toner images being produced and fused. As such, it is the main control system for components and other subsystems of machine 8 including the fusing apparatus 200 of the present disclosure.

Figure 2:
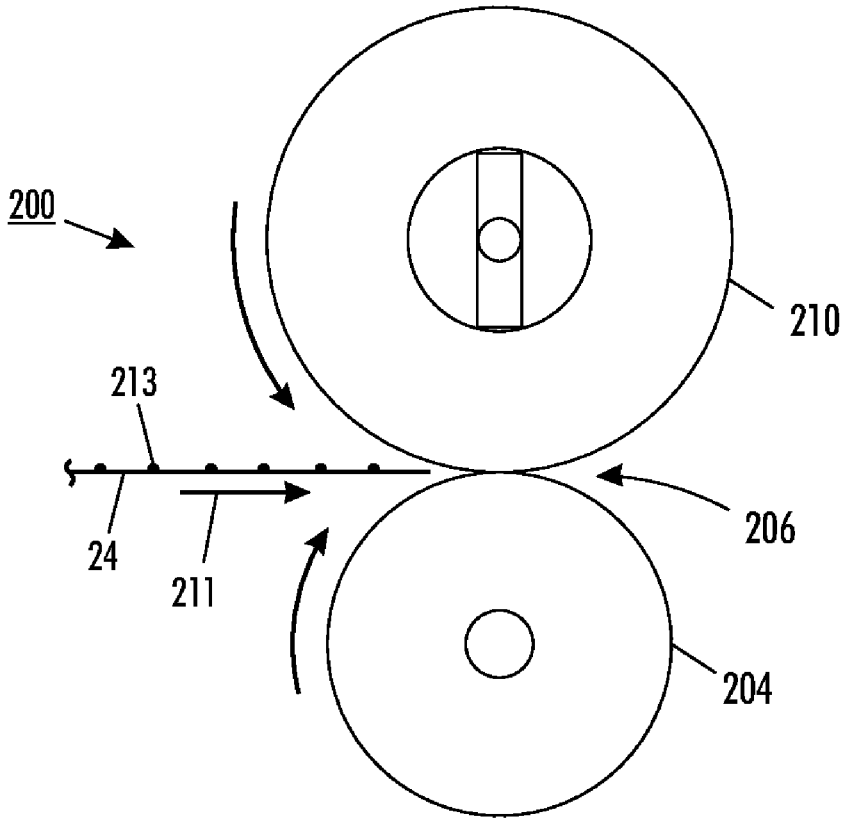
FIG. 2 is an enlarged schematic end view of the fusing apparatus of FIG. 1.

Referring now to FIG. 2, the fusing apparatus 200 of the present disclosure is illustrated in detail and is suitable for uniform and quality heating of unfused toner images 213 in the electrostatographic reproducing machine 8. As illustrated, fusing apparatus 200 includes a rotatable pressure member 204 that is mounted forming a fusing nip 206 with endless belt 210. A copy sheet 24 carrying an unfused toner image 213 thereon can thus be fed in the direction of arrow 211 through the fusing nip 206 for high quality fusing.

Figure 3A:
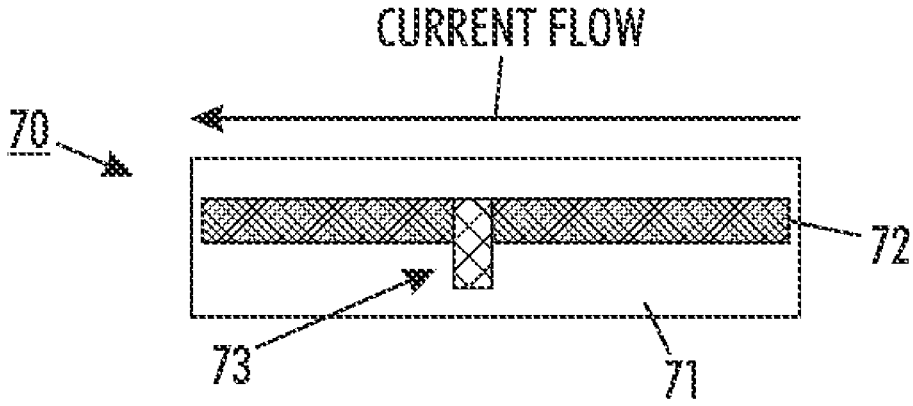
FIG. 3A PRIOR ART
FIG. 3A is a partial plan view of the heater portion of a conventional belt fuser.
Figure 3B:
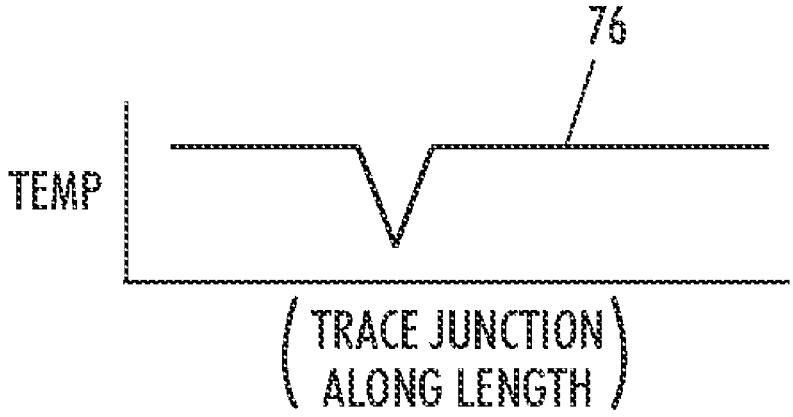
FIG. 3B PRIOR ART
FIG. 3B is a graph showing a negative temperature spike at a junction between resistive traces and a conductor trace of the heater of FIG. 3.

In prior art FIGS. 3A and 3B, heat flow in a series segmented multi-tap heater 70 is required to be uniform along the length of the heater. The conductor interface is the required method to select a segment of the ceramic heater to power. As shown, ceramic substrate layer 71 supports resistive trace 72 and conductive trace 73. When current travels in the direction of the arrow from a low resistance path (resistive trace) through the very low resistance path (conductor trace interface) the temperature drops due to the conductor trace generating no heat as represented by the negative temperature spike in line 76 of FIG. 3A.

Figure 4:
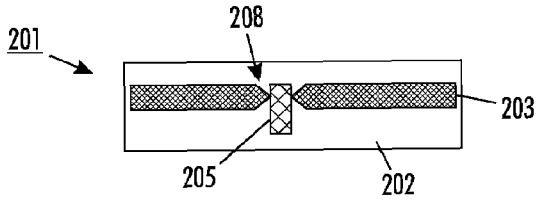
FIG. 4 is a partial plan view of the heater portion of first embodiment of an improved belt fuser that employs resistive traces that is tapered at an interface with a conductive trace.
Figure 4A:
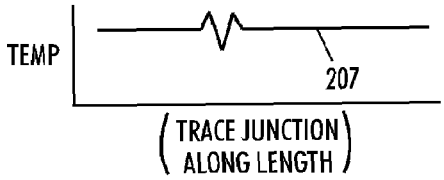
FIG. 4A is a graph showing a negative temperature spike at a junction between resistive traces and a conductor trace of the heater of FIG. 4.

To compensate for this drop in temperature, fuser 200 in FIG. 2 includes an improved heater 201 as shown in FIG. 4 that alters the heat flux in ceramic substrate 202 under the conductor trace 205 by increasing the temperature locally near the cold area or junction of the conductor/resistive trace. Altering the localized resistance near the junction of the conductor/resistive traces to thereby alter the localized power output is accomplished in many ways. For example, various inks with different resistive values can be used at the resistive/conductor trace interface, or alternatively, the resistive trace could be tapered at the intersection between the resistive trace and conductor trace. Ordinarily, the power and temperature through the resistive trace 203 is uniform (watts or resistance per unit length), but if the resistive trace is tapered down as shown at 208, the current and temperature increases. The energy will flow into the cold area based on the thermal conductivity of the ceramic substrate creating a more suitable temperature profile. The chart in FIG. 4A shows this fact since the negative spike in temperature in line 207 is much smaller than the negative temperature spike in line 76 of FIG. 3A.

It should be understood that belt 210 comprises a thermally conductive ceramic substrate layer 202, a friction coating layer (not shown), having a conductor/heater interface thereon; conductor trace 205; resistive trace 203; and a ceramic glazing electrical insulation layer (not shown). Power delivered at the conductor trace is delivered to the resistive trace causing it to heat up. The heat is then transferred through the thermally conductive ceramic substrate and the low friction coating layer to the belt. The resistive trace is electrically isolated by the ceramic glazing.

Figure 5:
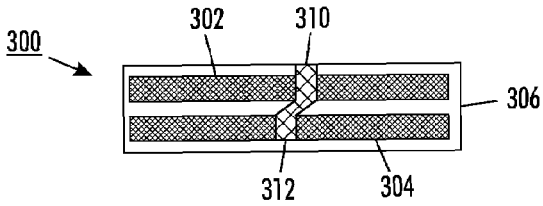
FIG. 5 is a partial plan view of the heater portion of a second embodiment of an improved belt fuser that employs multiple resistive traces that interface with an offset conductive trace.
Figure 5A:
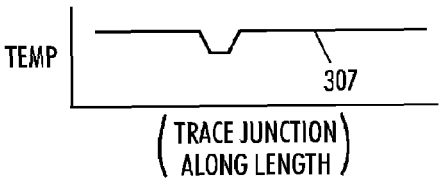
FIG. 5A is a graph showing a negative temperature spike at a junction between resistive traces and a conductor trace of the heater of FIG. 5.

In a second embodiment of the present disclosure in FIG. 5, an improved heater 300 includes multiple resistive traces 302 and 304 that are connected at a junction with conductor traces 310 and 312 that present an offset interface to the resistive traces. Conductor trace 310 intersects resistive trace 302 at a first location and conductor trace 312 intersects resistive trace 304 at a second location that is offset in the cross process direction by a minimum of one trace width, and so on. The conductor and resistive traces are mounted on ceramic substrate 306. As shown by the negative spike in line 307 in FIG. 5A, this embodiment reduces the magnitude of the temperature drop and can be tailored to requirements due to its flexibility.

Figure 6:
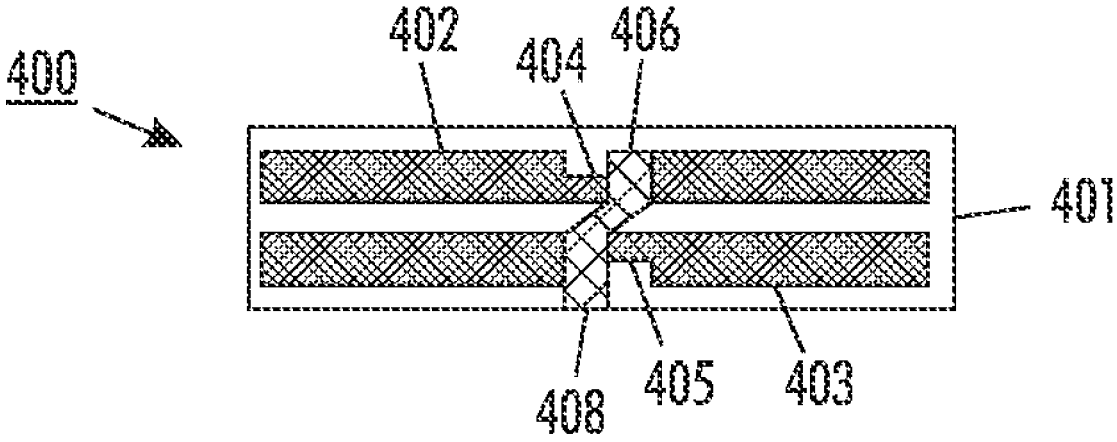
FIG. 6 is a partial plan view of the heater portion of a third embodiment of an improved belt fuser that employs multiple resistive traces with high current/temperature areas that interface with an offset conductive trace.

Alternatively, as shown in FIG. 6, the embodiments of FIGS. 4 and 5 can be combined to make an effective countermeasure against the temperature drop in the conductor interface area. For example, in FIG. 6, heater 400 includes a ceramic substrate 401 onto which are mounted resistive traces 402 and 403. Resistive traces 402 and 403 include reduced or narrow width portions 404 and 405 that interface with offset conductor traces 406 and 408. Narrow width portions 404 and 405 present high current/high temperature areas to conductor traces 406 and 408, respectively, in order to compensate for cold areas where the conductor traces 406 and 408 interfaces with resistive traces 402 and 403.

Figure 7:
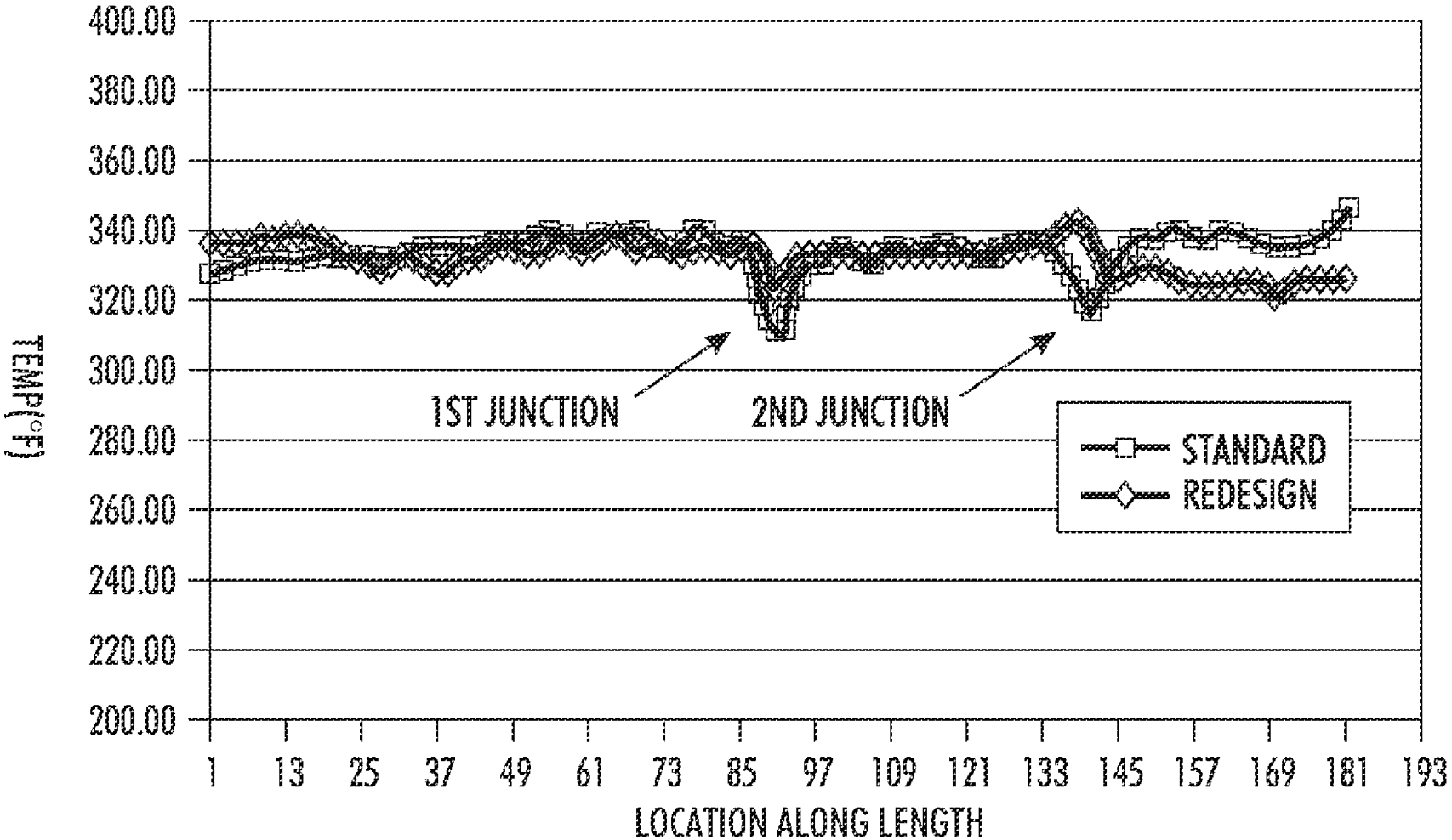
FIG. 7 is chart showing the resultant belt temperature outside a fuser nip exit for both a standard or conventional series heater and the cold spot compensation design of the present disclosure in FIG. 6.

The improvement of the heater embodiment of FIG. 6 is charted in FIG. 7 against a standard heater design. As shown, the standard heater design shows a drop of approximately 13° F. in both junction areas versus only <5° F. drop (actually no worse than noise) by the improved heater design of FIG. 6. In addition, differential gloss and fuse fix degradation of previous fusers was eliminated.

In recapitulation, the embodiments of the present disclosure address a problem of cold spots on a segmented ceramic fuser heater at the point of contact between a resistive trace and a conductor trace. An electrical contact to the segments is needed within the image area and the prior heater designs exhibit a cold spot at that point due to cooling. The present disclosure solves this problem by reducing the width of the resistive trace at the point of contact to provide extra heating to compensate for the heat loss. Alternatively, the conductor interface between multiple resistive traces can be offset to reduce the magnitude of the temperature drop at the resistive traces/conductor interface. Further yet, the resistive traces can be reduced in width and offset at the point of contact with the conductor to minimize heat loss.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A xerographic device adapted to print an image onto a copy sheet, comprising:

an imaging apparatus for processing and recording an image onto said copy sheet;

an image development apparatus for developing the image;

a transfer device for transferring the image onto said copy sheet; and a fuser for fusing the image onto said copy sheet, said fuser including an endless belt and a pressure roll that forms a nip therebetween through which said copy sheet is conveyed in order to permanently fuse the image onto said copy sheet, and wherein said endless belt includes a heater having at least two resistive traces intersecting with at least two conductor traces, and wherein said at least two conductor traces are offset with respect to said at least two resistive traces in order to reduce a magnitude of a temperature drop in a conductor interface area.

2. The xerographic device of claim 1, wherein said conductor traces are offset with respect to said resistive traces in a cross process direction by a minimum of one trace width.

3. The xerographic device of claim 1, wherein said at least two resistive traces are tapered down where they intersect with said at least two conductor traces.

4. A xerographic device adapted to print an image onto a copy sheet, comprising:

an imaging apparatus for processing and recording an image onto said copy sheet;

an image development apparatus for developing the image;

a transfer device for transferring the image onto said copy sheet; and a fuser for fusing the image onto said copy sheet, said fuser including an endless belt and a pressure roll that forms a nip therebetween through which said copy sheet is conveyed in order to permanently fuse the image onto said copy sheet, and wherein said endless belt includes a heater having at least two resistive traces intersecting with a conductor trace, and wherein said conductor trace intersect one of said at least two resistive traces at a first point and intersect another of said at least two resistive traces at a second point that is offset from said first point.

5. The xerographic device of claim 4, wherein said at least two resistive traces are tapered down where they intersect with said conductor trace.

6. A printing machine adapted to print an image on a copy sheet, comprising:

an imaging apparatus for processing and recording an image onto said copy sheet;

an image development apparatus for developing the image;

a transfer device for transferring the image onto said copy sheet; and a fuser for fusing the image onto said copy sheet, said fuser including an endless belt and a pressure roll that forms a nip therebetween through which said copy sheet is conveyed in order to permanently fuse the image onto said copy sheet, and wherein said endless belt includes a heater having at least two resistive traces intersecting with at least one conductor trace with said resistive traces having a portion of lesser width than a main portion thereof at the point of contact of said resistive traces with said at least one conductor trace, and wherein said at least one conductor trace is offset at the point of contact with respect to said resistive traces.

7. The printing machine of claim 6, wherein said at least one conductor trace is offset with respect to said resistive traces in a cross process direction by a minimum of one trace width.

8. The printing machine of claim 6, wherein said at least one conductor trace intersect one of said at least two resistive traces at a first point and intersect another of said at least two resistive traces at a second point that is offset from said first point.

9. The printing machine of claim 8, wherein said at least two resistive traces and said at least one conductor trace are mounted on a ceramic substrate.

* * * * *